United States Patent [19]

Chikaraishi et al.

[11] Patent Number: 4,585,257

[45] Date of Patent: Apr. 29, 1986

[54] SHIELD ARRANGEMENT FOR A CONTROL LEVER OF A VEHICLE SLIDING-DOOR LOCK

[75] Inventors: Takayo Chikaraishi, Kawasaki; Yasuo Yui, Isehara, both of Japan

[73] Assignee: Nissan Motor Company, Limited, Yokohama, Japan

[21] Appl. No.: 513,745

[22] Filed: Jul. 14, 1983

[30] Foreign Application Priority Data

Jul. 16, 1982 [JP] Japan ..... 57-124195

[51] Int. Cl.[4] ..... E05C 15/02

[52] U.S. Cl. ..... 292/1; 292/346; 292/DIG. 3; 292/DIG. 65

[58] Field of Search ..... 70/416, 418; 292/346, 292/1, DIG. 3, DIG. 65, DIG. 21

[56] References Cited

U.S. PATENT DOCUMENTS

| | | | |
|---|---|---|---|
| 2,049,796 | 8/1936 | Barry | 292/346 |
| 2,127,891 | 8/1938 | Storting | 292/346 |
| 3,111,339 | 11/1963 | Nodeau | 292/DIG. 65 |
| 3,377,094 | 4/1968 | Thompson | 292/346 |
| 4,235,465 | 11/1980 | Costello | 292/346 |

FOREIGN PATENT DOCUMENTS

| | | |
|---|---|---|
| 7009223 | 3/1970 | Fed. Rep. of Germany . |
| 1703532 | 11/1973 | Fed. Rep. of Germany . |
| 56-10579 | 8/1981 | Japan . |
| 852344 | 10/1960 | United Kingdom . |

*Primary Examiner*—Richard E. Moore

*Attorney, Agent, or Firm*—Schwartz, Jeffery, Schwaab, Mack, Blumenthal & Evans

[57] ABSTRACT

A lever for controlling a lock of an automobile door is mounted on the door and projects from the door. A shield is fixed to the door, and lies parallel to and inward of the lever so that the lever lies behind the shield as seen from the automobile passenger compartment. The shield extends forward of the free end of the lever to prevent access to the control lever when the door is in its closed position.

15 Claims, 4 Drawing Figures

SHIELD ARRANGEMENT FOR A CONTROL LEVER OF A VEHICLE SLIDING-DOOR LOCK

BACKGROUND OF THE INVENTION

This invention relates to a shield arrangement for a control lever of a vehicle sliding-door lock.

Some locks for automobile rear doors are provided with remote control units including an additional mechanism for child safety. Such mechanisms generally include a child safety lock lever. When the lock lever is in its locked position but a normal lock knob is in its unlocked position, the door can not be opened via a normal inside handle but can be opened via a normal outside handle. Generally, it is essential that when the door is closed, the lock lever can not be actuated from the inside of the automobile.

SUMMARY OF THE INVENTION

It is an object of this invention to provide a shield arrangement for a child safety lock lever of a vehicle rear sliding-door lock which prevents the actuation of the lever when the vehicle doors are closed.

Another object of this invention is to provide a shield arrangement for a child safety lock lever of a rear door lock of a vehicle with a center-pillarless body which prevents the actuation of the lever when the vehicle doors are closed.

In accordance with this invention, an arrangement applied to a lock of a vehicle door includes a lever for controlling the lock. The lever is mounted on the door and projects from the door. The arrangement also includes a shield fixed to the door. The shield lies inward of the lever so that the lever lies behind the shield as seen from the vehicle passenger compartment.

The above and other objects, features and advantages of this invention will be apparent from the following description of preferred embodiments thereof, taken in conjunction with the drawings.

DESCRIPTION OF THE PREFERRED EMBODIMENTS

Figure 1:
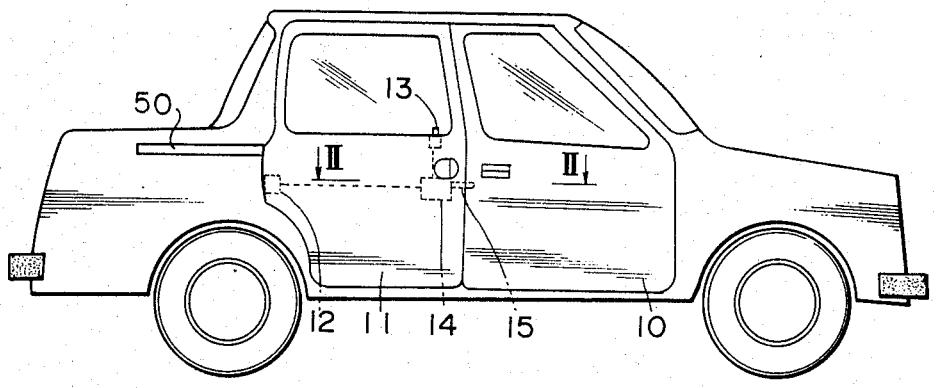
FIG. 1 is a side view of an automobile having a sliding door with a lock to which a first embodiment of this invention is applied.

With reference to FIG. 1, an automobile has a center-pillarless body with a hinged front door 10 and a sliding rear door 11. A conventional door lock 12 for the rear door 11 is located near the rear edge of the sliding door 11. A conventional lock knob 13 movably mounted on the sliding door 11 is connected to the lock 12 via a well-known remote control unit 14 attached near the front edge of the sliding door 11. The lock 12 can be controlled via the knob 13 in a conventional manner.

The combination of the lock 12 and the unit 14 is provided with a well-known child safety lock mechanism including a control lever 15 projecting frontward from the unit 14. The lock 12 can be controlled also via the child safety lock lever 15 in a known manner. The control lever 15 is movably mounted on the rear door 11 via the remote control unit 14.

Figure 3:
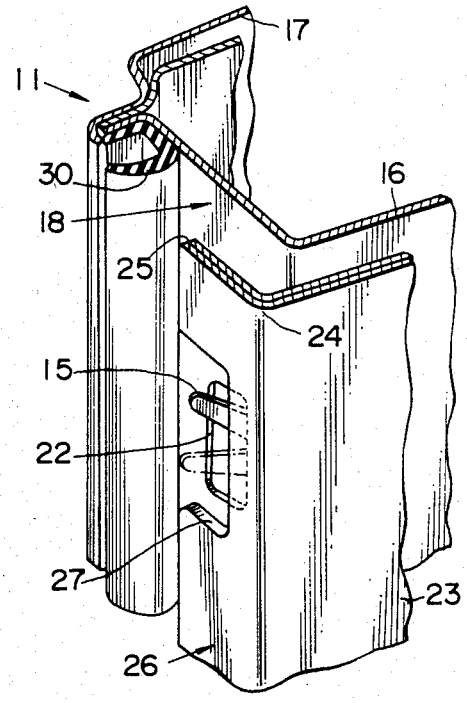
FIG. 3 is a perspective view of a front section of the sliding door of FIGS. 1 and 2.
Figure 2:
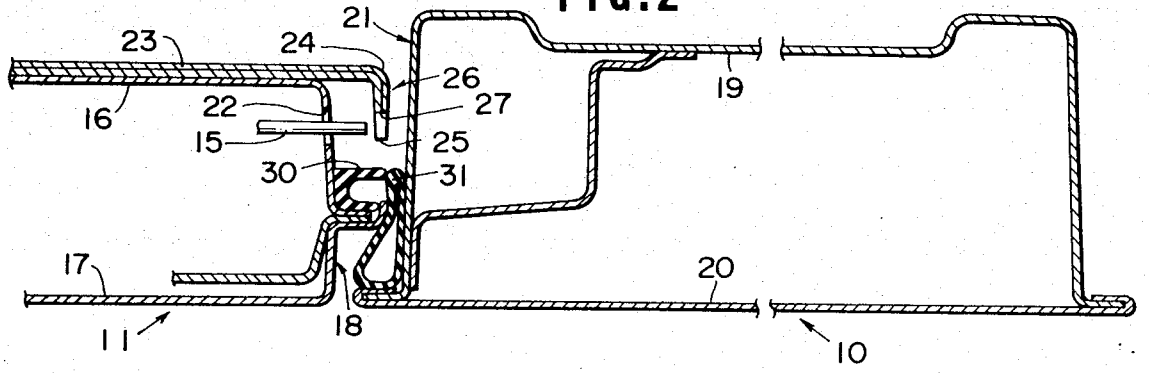
FIG. 2 is a cross-sectional plan view taken along the line II—II of FIG. 1.

As shown in FIGS. 2 and 3 relating to a first embodiment of this invention, the rear door 11 includes parallelly-spaced inner and outer panels 16 and 17. The front edges of the panels 16 and 17 bend at essentially a right angle to the outside and the inside with respect to the automobile, respectively, to join and form a transversely-extending front face 18 of the rear door 11.

As shown in FIG. 2, the front door 10 includes parallelly-spaced inner and outer panels 19 and 20. The rear edge of the inner panel 19 bends to the outside with respect to the automobile to join the rear edge of the outer panel 20 and form a transversely-extending rear face 21 of the front door 10.

When the front door 10 and the rear door 11 are in their closed positions as shown in FIG. 2, the rear door front face 18 opposes the front door rear face 21 with a predetermined gap left therebetween. This gap is chosen so as to prevent impact between the doors 10 and 11 when they move into and out of the closed positions. Weatherstripping 30 and 31 attached to the front face 18 and the rear face 21 respectively seals the gap between the faces 18 and 21 when the doors 10 and 11 are in the closed positions.

As shown in FIGS. 2 and 3, the portion of the rear door inner panel 16 defining part of the front face 18 is provided with an opening 22, through which the child safety lock lever 15 movably extends toward the front of the automobile. The control lever 15 extends from the remote control unit 14 as described previously and then through the opening 22, and terminates in the gap between the door faces 18 and 21 when the doors 10 and 11 are in the closed positions.

The surface of the sliding door 11 facing the automobile passenger compartment is covered with a door trim 23, which is in the form of a board bonded contiguously to the inner panel 16. The door trim 23 extends forwards beyond the right-angled bend or corner of the front edge of the inner panel 16 and lies parallel to and inward of the control lever 15 to form a first section, and then bends at essentially a right angle to the outside with respect to the automobile to form a vertical edge 24 and a second section forward of the free end of the control lever 15. From the bend 24, the door second section of trim 23 extends outward to an edge 25 immediately outward and slightly forward of the free end of the control lever 15. In this way, the control lever 15 lies outward of the forwardly-extending section of the extension of the door trim 23 and lies rearward of the outwardly-extending section of the extension of the door trim 23.

The extension of the door trim 23 extends vertically with respect to the automobile and has essentially a constant horizontal profile. The extension of the door trim 23 covers the range of vertical movement of the control lever 15. Specifically, the positions of the upper and lower edges of the extension of the door trim 23 are considerably higher and lower than the upper and lower limits of the range of vertical movement of the control lever 15, respectively.

In this way, the extension of the door trim 23 forms a shield 26 for the control lever 15 which is arranged such that the control lever 15 lies behind the shield 26 as seen from the automobile passenger compartment. When the doors 10 and 11 are in the closed positions, the shield 26 is located in the gap between the door faces 18 and 21 and is spaced from the control lever 15 and the front door 10. The location of the shield 26 is chosen so as not to obstruct movement of the doors 10 and 11 into and out of the closed position.

The above-mentioned arrangement and location of the shield 26 reliably ensures the prevention of actuation of the control lever 15 when the doors 10 and 11 are in the closed positions.

The outwardly-extending section of the shield 26 has an opening or groove 27 directly in front of the control lever 15. The location and dimensions of the groove 27 are designed so as to allow the control lever 15 to be easily actuated when at least one of the doors 10 and 11 is opened. Specifically, the groove 27 is of such an extent as to directly oppose and adequately include the range of movement of the control lever 15 as seen in a direction from the front to the rear of the automobile.

It is preferable that the gap between the shield 26 and the front door 10 is chosen so as to prevent an automobile passenger from reaching the control lever 15 when the doors 10 and 11 are in the closed positions.

Figure 4:
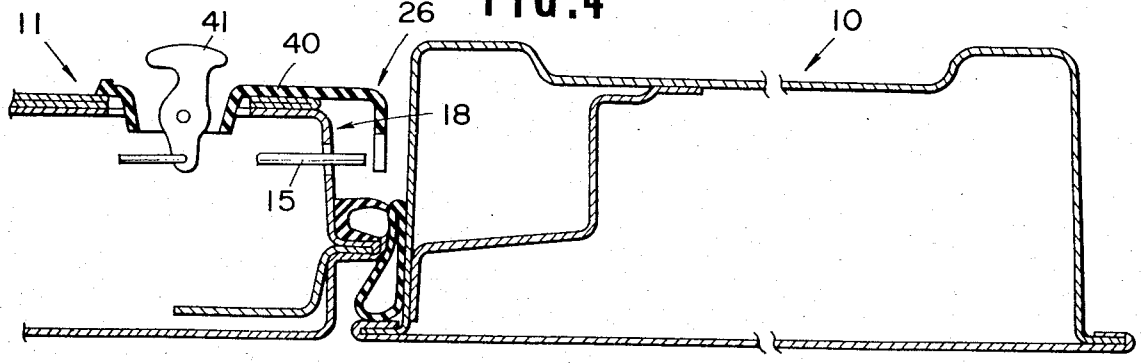
FIG. 4 is a cross-sectional plan view, similar to FIG. 2, showing a second embodiment of this invention.

FIG. 4 shows a second embodiment of this invention which differs from the first embodiment as described below. The shield 26 consists of an extension of an escutcheon 40 for a rear-door inside handle 41. The escutcheon 40 is attached to the rear door 11 in a conventional way. Specifically, the escutcheon 40 projects forward of the front face 18 of the rear door 11 forming a first section of shield 26 and then bends to the outside to form a second section of shield 26 so that the control lever 15 lies behind the extension of the escutcheon 40 forming the shield 26 as seen from the automobile passenger compartment. Other points of the design of the second embodiment are similar to those of the first embodiment.

It should be understood that further modifications and variations may be made in this invention without departing from the spirit and scope of this invention as set forth in the appended claims.

What is claimed is:

1. A sliding door arrangement for a vehicle comprising:

a door having an inner panel, a front face connected at an interior edge to a front edge of said inner panel and disposed substantially transverse to said inner panel, and an outer panel connected at a forward edge to an exterior edge of said front face and disposed substantially transverse to said front face and substantially parallel to said inner panel;

a lock mechanically coupled to said door and arranged to prevent opening of said door when said lock is in a locked state;

a lever mechanically coupled to said lock for controlling said lock, said lever being arranged to project from an aperture in said front face; and a shield having a first section connected to said inner panel and projecting past said front edge of said inner panel adjacent and substantially parallel to said lever, and a second section supported by said first section and arranged parallel and opposed to said front face so that access to said lever is blocked by said shield when said door is closed.

2. A sliding door arrangement as claimed in claim 1, wherein said door further includes a door trim attached to said inner panel, and wherein said shield is integral with said door trim.

3. A sliding door arrangement as claimed in claim 1 wherein said door further includes an inside handle escutcheon attached to said inner panel, and wherein said shield is integral with said inside handle escutcheon.

4. A sliding door arrangement as claimed in claim 1 wherein said lock includes a child safety lock mechanism, and wherein said lever is mechanically coupled to said child safety lock mechanism to control said child safety lock mechanism.

5. A sliding door arrangement as claimed in claim 4, wherein said door further includes a door trim attached to said inner panel, and wherein said shield is integral with said door trim.

6. A sliding door arrangement as claimed in claim 4 wherein said door further includes an inside handle escutcheon attached to said inner panel, and wherein said shield is integral with said inside handle escutcheon.

7. A sliding door arrangement as claimed in claim 4, wherein said second section includes a shield aperture arranged opposite said aperture in said front face.

8. A vehicle comprising:

a center-pillarless body a rear door slidingly connected to said body, said rear door having an inner panel, a front face connected at an interior edge to a front edge of said inner panel and disposed substantially transverse to said inner panel, and an outer panel connected at a forward edge to an exterior edge of said front face and disposed substantially transverse to said front face and substantially parallel to said inner panel;

a lock mechanically coupled to said door and arranged to prevent opening of said door when said lock is in a locked state;

a lever mechanically coupled to said lock for controlling said lock, said lever being arranged to project from an aperture in said front face; and a shield having a first section connected to said inner panel and projecting past said front edge of said inner panel adjacent and substantially parallel to said lever, and a second section supported by said first section and arranged parallel and opposed to said front face so that access to said lever is blocked by said shield when said door is closed.

9. A sliding door arrangement as claimed in claim 8, wherein said door further includes a door trim attached to said inner panel, and wherein said shield is integral with said door trim.

10. A sliding door arrangement as claimed in claim 8, wherein said door further includes an inside handle escutcheon attached to said inner panel, and wherein said shield is integral with said inside handle escutcheon.

11. A sliding door arrangement as claimed in claim 8, wherein said second section includes a shield aperture arranged opposite said aperture in said front face.

12. A child-proof lock for a rearwardly sliding door of a vehicle comprising:

a lock mechanism structured to be disposed within said door;

a lever mechanically coupled to said lock mechanism and structured to project from an aperture in a front face of said door;

a shield having a first substantially flat section and a second section connected to and substantially transverse to said first section; and means for attaching said shield to an inner panel of said door, for positioning said first section to project past said front edge of said door at a level corresponding to said aperture in said front face of said door, and for positioning said second section substantially parallel said front face and opposed to said aperture.

13. A child-proof lock as claimed in claim 12, wherein said first section of said shield is structured to serve as trim on said inner panel of said door.

14. A child-proof lock as claimed in claim 12, wherein said first section of said shield is structured to serve as an inside handle escutcheon.

15. A child-proof lock as claimed in claim 12, wherein said second section includes a shield aperture arranged to oppose said aperture in said front edge when said second section is positioned substantially parallel to said front edge.

* * * * *